United States Patent [19]

Williams

[11] 4,104,066

[45] Aug. 1, 1978

[54] COLD PRESSURE FIX TONERS FROM POLYCAPROLACTONE

[75] Inventor: Meurig W. Williams, Rochester, N.Y.

[73] Assignee: Xerox Corporation, Stamford, Conn.

[21] Appl. No.: 662,629

[22] Filed: Mar. 1, 1976

[51] Int. Cl.[2] ..... G03G 9/10; G03G 13/08; G03G 9/08

[52] U.S. Cl. ..... 96/1 SD; 252/62.1 P; 427/19

[58] Field of Search ..... 252/62.1 P; 427/19; 96/1 SD

[56] References Cited

U.S. PATENT DOCUMENTS

| | | | |
|---|---|---|---|
| 3,598,799 | 8/1971 | Naylor | 260/879 |
| 3,669,922 | 6/1972 | Bartsch et al. | 260/41 R |
| 3,670,045 | 6/1972 | Koleske et al. | 260/830 R |
| 3,674,736 | 7/1972 | Lerman et al. | 260/41 R |
| 3,804,764 | 4/1974 | Strella et al. | 252/62.1 P |
| 3,925,219 | 12/1975 | Strong | 252/62.1 P |

FOREIGN PATENT DOCUMENTS 1,210,665 10/1970 United Kingdom.

OTHER PUBLICATIONS

New Polycaprolactone Thermoplastic Polymers, PCL-300 and PCL-700.

*Primary Examiner*—James R. Hoffman

[57] ABSTRACT

A pressure-fixable developer utilizing a toner comprising a polycaprolactone having a number average molecular weight of between about 2,000 and about 15,000.

21 Claims, No Drawings

COLD PRESSURE FIX TONERS FROM POLYCAPROLACTONE

BACKGROUND OF THE INVENTION

This invention relates to electrostatography, and more particularly to improved electrostatographic developing materials and the use thereof.

Electrostatography is best exemplified by electrophotography. The basic electrophotographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resulting latent electrostatic image by depositing on the image a finely-divided electroscopic material referred to in the art as "toner". The toner will normally be attracted to those areas of the layer which retain a charge, thereby forming a toner image corresponding to the latent electrostatic image. This powder image may then be transferred to a support surface such as paper. The transferred image may subsequently be permanently affixed to the support surface as by heat. Instead of latent image formation by uniformly charging the photoconductive layer and then exposing the layer to a light-and-shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing steps.

Final copies of the toner image are generally prepared by heating the toner image on a suitable support to a temperature at which the toner flows in order to effect fusing of the toner to the support medium. In order to increase the speed at which toners may be fixed to a support attempts have been made to form toners of low molecular weight resins which are easily heat fused at relatively low temperatures, but such attempts have not generally been successful in that such toners tend to block at low temperatures.

It has been proposed that pressure-fixable toners comprising a wax in combination with a polymer material be used as toner material. Examples of these materials are those disclosed in British Pat. No. 1,210,665 and U.S. Pat. No. 3,925,219. These toners have not proved to be entirely satisfactory as they exhibit tendencies toward blocking, shortness of developer life due to impacting on the carrier, filming of the photoreceptor surface, and difficulty in attrition of the soft materials to toner size particles.

It also has been proposed to pressure-fix relatively hard polymeric material by the use of high pressures. This also is found to not be totally satisfactory as the pressures required to pressure fix conventional toners tended to degrade the strength and appearance of paper and further did not result in satisfactory fix to the paper when flexed.

It also has been proposed to utilize in pressure-fixing applications, encapsulated toners comprising a hard polymeric shell material surrounding a core of liquid ink or soft solid flowable material. Results using such toners have proved to be less than fully satisfactory in many cases as there is difficulty in forming perfect shell materials and therefore blocking of the material occurs due to leakage of the core. Further, the formation process of encapsulated material are difficult and expensive. Accordingly, there remains a need for new toners which may be pressure-fixed rapidly.

SUMMARY OF THE INVENTION

It is an object of this invention to overcome the abovenoted deficiencies.

It is a further object to provide a toner which can be pressure-fixed rapidly.

It is an additional object to provide a pressure-fixable toner which can withstand the stresses in the developing process.

It is a further additional object of this invention to provide a toner which resists blocking.

Another object of the invention is to provide a pressure-fixable toner of low cost and simple manufacturing methods.

It is a still further object of the invention to provide a toner which may be fixed with low heat and low pressure.

It is an additional object of this invention to provide a pressure-fixable toner which will produce clear permanent images.

It is a further additional object of this invention to provide a pressure-fixable toner which may be fixed at high speeds.

It is a further object to provide a developer composition for development of elastrostatic latent images to form pressure-fixable toner images.

It is an additional object to provide a method of developing electrostatic latent images with pressure-fixable toner.

The above and other objects of the invention are generally accomplished by providing a toner comprising polycaprolactone, polycaprolactone blends or polycaprolactone block copolymers having a number average molecular weight of about 2,000 to about 15,000 and a colorant material.

DETAILED DESCRIPTION OF THE INVENTION

Polycaprolactones are commercialized in a variety of molecular weights and have been used in a variety of ways such as in fibers and to improve properties of other polymers with which they are blended small amounts. The polycaprolactone resins (PCL) are characterized by a structure which is $$\left( -CH_2CH_2CH_2CH_2CH_2\overset{\overset{\displaystyle O}{\|}}{C}-O- \right)_n$$

where $n$ can vary from 100 to 1,000, depending on the particular molecular weight grade of PCL.

It has now been found that the polycaprolactones within a selected molecular weight and polycaprolactones when in blends and block copolymers of selected molecular weight are suitable for use as toner in processes using pressure-fixing.

Polycaprolactone of any suitable molecular weight which results in toner having the ability to pressure-fix at reasonable pressure may be used in the invention. A number average molecular weight of about 2,000 to about 15,000 has been found to be suitable. The optimum molecular weight for polycaprolactone, that is not blended and not copolymerized, for use in the invention is about 6,000 number average molecular weight which gives clear, sharp images at relatively low fixing pressures while maintaining good triboelectric properties and resistance to blocking.

Any block copolymer of polycaprolactone which displays suitable fix at relatively low pressure and desirable triboelectric properties may be used in the instant invention. A number average molecular weight of about 2,000 to about 15,000 has been found to be suitable. A preferred molecular weight of the block copolymer is about 6,000 number average which has been found to result in a block copolymer of desirable triboelectric properties which is fixable at a relatively low pressure. Typical of suitable materials to form the block copolymer with PCL are low molecular weight amorphous materials, the polymerization being initiated with the carboxyl group attached to these materials. A preferred unit for the block polymer is the dimer acid, Empol 1010, sold by Emery Industries which is an amorphous cyclic dimer of a long chain fatty acid.

Any suitable polyblend of polycaprolactone may be used in the processes of the invention. The polycaprolactone may be blended with any suitable amount of another polymer. Suitable blends have been found to be those containing up to about 50 percent by weight of the added polymer and greater than about 50 percent of polycaprolactone. The preferred polyblends are stabilized by the presence of carboxyl groups in both polymers. The carboxyl groups are terminal or incorporated into the chain with concentrations of up to about 5 mole percent. Additive polymers which have been found suitable for the invention are polyethylene, polyvinyl acetate, styrene butylmethacrylate copolymer and polyvinyl chloride, each in a molecular weight of about 2,000 to about 15,000 number average molecular weight. In the case of the polyblends, the polycaprolactone is also found to be suitable at molecular weights of about 2,000 to about 15,000 number average molecular weight. The PCL and additive polymer may be blended by melt or solution blending.

The toner of the present invention includes a colorant, either a pigment or dye, in a quantity sufficient to impart color to the resin composition, generally in a quantity up to about 25 percent, by weight, and particularly from about 1 percent to about 20 percent, by weight, of the toner, whereby the resulting toner will form a clear visible image on a transfer member. Any one of a wide variety of pigments or dyes which do not adversely affect the properties of the toner may be employed to impart color to the resin; e.g. furnace black, carbon black, a commercial red, blue or yellow dye, and since such dyes and/or pigments are well-known in the art, no detailed enumeration thereof is deemed necessary for a full understanding of the invention. A preferred colorant for the toner of the instant invention is carbon black in an amount of from about 5 to 10 percent by weight.

The colored toner may be prepared by any one of a wide variety of procedures for forming a uniform dispersion of the dye or pigment in the resinous material. Thus, for example, the resinous material and a suitable pigment may be heated and blended on a rubber mill and then allowed to cool and harden to encase the pigment within the resinous material. The pigmented or dyed resinous material is then micronized; e.g. in a jet pulverizer, to particles having a particle size generally employed for a toner; generally an average particle size of less than about 30 microns, preferably an average particle size from about 10 to about 20 microns. Alternatively, the finely-divided toner may be prepared by spray drying a toner composition of the colorant and resin dissolved in a solvent.

The above procedures and other procedures for producing colored toner of the desired particle size are generally known in the art and may be employed for producing the toner of the present invention and therefore, no detailed discussion thereof is necessary for a full understanding of the invention.

When the toner mixtures of this invention are to be employed in a magnetic brush or cascade development process, the toner should have an average particle size by weight percent less than about 30 microns and preferably between about 4 and about 20 microns for optimum results. For use in powder cloud development methods, particle diameters of slightly less than 1 micron are preferred.

Suitable coated and uncoated carrier materials for magnetic brush and cascade development are well known in the art. The carrier particles comprise any suitable solid material, provided that the carrier particles acquire a charge having an opposite polarity to that of the toner particles when brought in close contact with the toner particles so that the toner particles adhere to and surround the carrier particles. When a positive reproduction of the electrostatic images is desired, the carrier particle is selected so that the toner particles acquire a charge having a polarity opposite to that of the electrostatic image. Alternatively, if a reversal reproduction of the electrostatic image is desired, the carrier is selected so that the toner particles acquire a charge having the same polarity as that of the electrostatic image. Thus, the materials for the carrier particles are selected in accordance with its triboelectric properties in respect to the electroscopic toner so that when mixed or brought into mutual contact one component of the developer is charged positively if the other component is below the first component in the triboelectric series and negatively if the other component is above the first component in a triboelectric series. By proper selection of materials, in accordance with their triboelectric effects, the polarities of their charge when mixed are such that the electroscopic toner particles adhere to and are coated on the surfaces of carrier particles and also adhere to that portion of the electrostatic image-bearing surface having a greater attraction for the toner than the carrier particles. Typical carriers include sodium chloride, ammonium chloride, aluminum potassium chloride, iron, nickel, steel, Rochelle salt, sodium nitrate, aluminum nitrate, potassium chlorate, granular zircon, granular silicon, methyl methacrylate, glass, silicon dioxide and the like. The carriers may be employed with or without a coating. Many of the foregoing and other typical carriers are described by L. E. Walkup et al in U.S. Pat. No. 2,638,416 and E. N. Wise in U.S. Pat. No. 2,618,552. Methyl terpolymer coated steel carrier is found to be suitable for use with the toner of the invention. An ultimate coated carrier particle diameter between about 50 microns to about 1,000 microns is preferred because the carrier particles then possess sufficient density and inertia to avoid adherence to the electrostatic images during the development process. Adherence of carrier beads to xerographic drums is undesirable because of the formation of deep scratches on the surface during the imaging transfer and drum cleaning steps, particularly where cleaning is accomplished by a web cleaner such as the web disclosed by W. P. Graff, Jr. et al in U.S. Pat. No. 3,186,838. Also print deletion occurs when carrier beads adhere to xerographic imaging surfaces. Generally speaking, satisfactory results are obtained when about 1 part toner is used with about 10 to 200 parts by weight of carrier.

The toner compositions of the instant invention may be employed to develop latent electrostatic images on any suitable electrostatic latent image-bearing surface including conventional photoconductive surfaces. Well known photoconductive materials include vitreous selenium, organic or inorganic photoconductors embedded in a nonphotoconductive matrix, organic or inorganic photoconductors embedded in a photoconductive matrix, or the like. Representative patents in which photoconductive materials are disclosed included U.S. Pat. No. 3,121,006 to Middleton, U.S. Pat. No. 3,121,007 to Middleton, and U.S. Pat. No. 3,151,982 to Corrsin.

The toners of the present invention are capable of being fixed to a suitable support means such as paper to provide a finished copy by the application of pressure alone. The fixable pressure required for affecting pressure-fixing varies with the particular toner employed and delay of pressure application. The pressure is preferably provided by pressing the transfer material having the toner image thereon between a pair of polished metal rollers that are in contact with each other under a specified pressure. In general, a roll pressure of greater than 300 pounds per linear inch is desirable to result in adequate pressure fixing without the use of heat. A preferred rate of image fixing is a pressure of 400 pounds per linear inch at a speed of 10 inches per second. Such images when subjected to the taber abrader test show an adequately fixed image. The roll loading in pounds per linear inch is the total applied force divided by the length of the roll. In some cases the pressure fixing of the toner to the support medium may be heat assisted. The use of the heated fuser roll is well known and the roll may be coated or uncoated and may utilize an elastomeric coated backup roll. The toners of the instant invention are capable of fusing at low heat with application of low pressure. Although the toners of the instant invention are particularly suitable for preparation of copies by only the use of pressure without heat, it is possible to also fix them by heat assisted methods at high speeds.

The following examples except for the control examples further define, describe and compare methods of preparing the toner materials of the invention. Parts and percentages are by weight unless otherwise indicated. Molecular weights are by the number average method. These examples are intended to illustrate the various preferred embodiments of the present invention.

EXAMPLE I

A toner mixture is prepared comprising about 5 parts by weight of carbon black (Neospecta II) to about 95 parts by weight of a polylactone of a molecular weight of about 6,000. After mixing the composition is rubber milled to yield a uniformly dispersed composition of carbon black in the thermoplastic resin body. The resulting mixed composition is cooled and is then finely-divided by being jet pulverized to yield toner particles having an average particle size of about 10 to about 15 microns. The toner material was combined with a conventional carrier in a Xerox Model D flat plate copier. The paper bearing a toner image was removed from the Model D copier and passed through steel rollers which were under a pressure of about 400 pounds per linear inch. A sharp image of adequate fix was obtained.

EXAMPLE II

The process of Example I was repeated except that a polycaprolactone of a number average molecular weight of about 3,000 was substituted for the polycaprolactone of Example I. This resulted in a clear, sharp image of good fix on the paper.

EXAMPLE III

As a control, the process of Example II was repeated with the exception that the pressure rolls were maintained at a pressure of about 250 pounds per linear inch. The image in this instance did not show adequate fix and could be scraped from the paper.

EXAMPLE IV

A toner mixture is prepared comprising about 8 parts by weight of carbon black (Mogul L) and about 60 parts of weight of polycaprolactone of a number average molecular weight of about 10,000, and about 40 parts by weight of 65/35 styrene-n-butylmethacrylate copolymer. After melting and preliminary mixing, the composition is placed in a rubber mill and thoroughly milled to yield a uniformly dispersed composition of the carbon black in the thermoplastic body. The resulting mixed composition is cooled and then finely subdivided in a jet pulverizer to yield toner particles having an average particle size of about 7 to about 12 microns. The toner particles are utilized in a Xerox Model D flat plate processor to produce a toner image on plain paper. The paper is passed through polished steel rollers maintained at about 400 pounds per linear inch pressure. A sharp toner image of good fix is obtained.

EXAMPLE V

The process of Example IV is repeated except that 30 parts of polyvinyl acetate having a number average molecular weight of about 8,000 are substituted for the 40 parts styrene-n-butylmethacrylate copolymer. A toner image of adequate fix and image quality is found to result.

EXAMPLE VI

The process of Example IV is repeated except that 20 parts of polyvinyl chloride having a number average molecular weight of approximately 5,000 is substituted for the styrene butylmethacrylate copolymer. A toner image of adequate fix and good image quality is found to result.

EXAMPLE VII

As a control, the process of Example I is performed utilizing a polycaprolactone of number average molecular weight of about 20,000. The toner image is found to not fix adequately and may be easily removed from the paper after passing through the pressure roll.

EXAMPLE VIII

Empol 1010 (30 g) and caprolactone (150 g) is heated at 150° C under nitrogen overnight. After cooling, the mixture is poured into methanol, to precipitate a solid. This is dissolved in chloroform and reprecipitated with methanol. There is obtained, after drying, a block copolymer solid melting at 55° C. The number average molecular weight is 6,500.

Toner is made with 5 percent Mogul L carbon black by the mixing and attrition method of Example I. Image formation is also carried out as in Example I and the image is cold pressure fixed at 400 pli at 10 inches/sec. An adequate degree of fix was obtained.

Although specific materials and conditions were set forth in the above exemplary processes in making and using the compounds of this invention, these are merely illustrations of the present invention. For instance, while the examples disclose toner formation by attrition, it is possible to form toner by spray drying from a solution. Various other substituents and other processes such as those listed above may be substituted for those in the examples with similar results. For instance, it is possible to add further materials to the toner in addition to the colorant. It is possible to add release material to aid in release from the fuser oil. It is further possible to add magnetic particles such as ferrites to the toner or to use magnetic pigments so as to form magnetic toner. Further, while the development process used in the examples utilizes a carrier, it is of course possible to utilize development methods other than those requiring a carrier particle. Other additives such as those to reduce humidity sensitivity of the toner or to plasticize the PCL material during formation may be added. Other modifications of the present invention will occur to those skilled in the art upon reading of the present disclosure.

What is claimed is:

1. A pressure-fixable toner capable of being fixed to a support medium in image configuration by the application of pressure comprising a colorant and a material selected from the group consisting essentially of polycaprolactone polymer, polycaprolactone polymer blends and polycaprolactone copolymers, wherein said polycaprolactone polymer has a number average molecular weight of between about 2,000 and about 15,000, said polycaprolactone blends comprise greater than about 50 percent by weight of polycaprolactone and said polycaprolactone copolymers comprise block copolymers having a number average molecular weight of between about 2,000 and about 15,000.

2. The toner of claim 1 wherein said polycaprolactone copolymer is a block copolymer having a number average molecular weight of about 6,000.

3. The toner of claim 1 wherein said polycaprolactone consists essentially of a polycaprolactone having a number average molecular weight of about 6,000.

4. The toner of claim 1 wherein said polylactone polymer blends comprise blends of polylactone polymer with a member selected from the group comprising polyethylene, polyvinyl acetate, polybutyl methacrylate copolymer, polyvinyl chloride and mixtures thereof, wherein said polycaprolactone is present in an amount greater than 50 percent by weight of the polymer blend.

5. The toner of claim 4 wherein the additive polymer blended with caprolactone polymer to form said polycaprolactone polymer blends has a number average molecular weight of about 2,000 to about 15,000.

6. The toner of claim 1 wherein said colorant is carbon black.

7. The toner of claim 1 further comprising magnetic particles.

8. An electrophotographic developer comprising a carrier and a toner capable of being fixed to a support medium in image configuration by the application of pressure comprising a colorant and a material selected from the group consisting essentially of polycaprolactone polymer, polycaprolactone polymer blends and polycaprolactone block copolymers wherein said polycaprolactone polymer has a number average molecular weight of between about 2,000 and about 15,000, said polycaprolactone blends comprise greater than about 50 percent by weight of polycaprolactone and said polycaprolactone copolymers comprise block copolymers having a number average molecular weight of between about 2,000 and about 15,000.

9. The developer of claim 8 wherein said polycaprolactone copolymer is a block copolymer having a number average molecular weight of about 6,000.

10. The developer of claim 8 wherein said polycaprolactone consists essentially of a polycaprolactone having a number average molecular weight of about 6,000.

11. The developer of claim 8 wherein said polycaprolactone polymer blends comprise blends of polycaprolactone polymer with a number selected from the group comprising polyethylene, polyvinyl acetate, polybutyl methacrylate copolymer, polyvinyl chloride and mixtures thereof, wherein said polycaprolactone is present in an amount greater than 50 percent by weight of the polymer blend.

12. The developer of claim 11 wherein the additive polymer blended with caprolactone polymer to form said polycaprolactone polymer blends has a number average molecular weight of about 2,000 to about 15,000.

13. The developer of claim 8 wherein said colorant is carbon black.

14. The developer of claim 8 further comprising magnetic particles.

15. An electrostatographic imaging process comprising establishing an electrostatic latent image on a surface and contacting said surface with a pressure-fixable toner capable of being fixed to a support medium in image configuration by the application of pressure comprising a colorant and a material selected from the group consisting essentially of polycaprolactone polymer, polycaprolactone blends and polycaprolactone copolymers wherein said polycaprolactone polymer has a number average molecular weight of between about 2,000 and about 15,000, said polycaprolactone blends comprise greater than about 50 percent by weight of polycaprolactone and said polycaprolactone copolymers comprise block copolymers having a number average molecular weight of between about 2,000 and about 15,000.

16. The process of claim 15 wherein said polycaprolactone copolymer is a block copolymer having a number average molecular weight of about 6,000.

17. The process of claim 15 wherein said polycaprolactone polymer consists essentially of a polycaprolactone having a number average molecular weight of about 6,000.

18. The process of claim 15 wherein said polycaprolactone polymer blends comprise blends of polycaprolactone polymer with a member selected from the group consisting of polyethylene, polyvinyl acetate, polybutyl methacrylate copolymer, polyvinyl chloride and mixtures thereof, wherein said polycaprolactone is present in an amount greater than 50 percent by weight of the polymer blend.

19. The process of claim 18 wherein the additive polymer blended with caprolactone polymer to form said polycaprolactone polymer blends has a number average molecular weight of about 2,000 to about 15,000.

20. The process of claim 19 wherein said colorant is carbon black.

21. The process of claim 15 wherein said toner comprises magnetic particles.

* * * * *